US010655803B2

(12) United States Patent
Magno et al.

(10) Patent No.: US 10,655,803 B2
(45) Date of Patent: May 19, 2020

(54) LINEAR LIGHT EMITTING DIODE LUMINAIRES

(71) Applicant: ABL IP HOLDING LLC, Atlanta, GA (US)

(72) Inventors: John N. Magno, St. James, NY (US); Eric W. Teather, Elkton, MD (US); Christopher C. Rich, Rancho Palos Verdes, CA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/421,422

(22) Filed: May 23, 2019

(65) Prior Publication Data

US 2019/0277459 A1 Sep. 12, 2019

Related U.S. Application Data

(63) Continuation of application No. 15/441,940, filed on Feb. 24, 2017, now Pat. No. 10,317,021.

(51) Int. Cl.

| | |
|---|---|
| ***F21S 4/20*** | (2016.01) |
| ***F21V 3/00*** | (2015.01) |
| ***F21V 17/16*** | (2006.01) |
| *F21Y 103/10* | (2016.01) |
| *F21Y 115/10* | (2016.01) |

(52) U.S. Cl.

CPC ..... *F21S 4/20* (2016.01); *F21V 3/00* (2013.01); *F21V 17/164* (2013.01); *F21Y 2103/10* (2016.08); *F21Y 2115/10* (2016.08)

(58) Field of Classification Search

CPC ..... F21S 4/20; F21V 3/02; F21V 7/22; F21V 15/01

See application file for complete search history.

(56) References Cited

U.S. PATENT DOCUMENTS

| | | | |
|---|---|---|---|
| 1,941,079 | A | 12/1933 | Exelmans |
| 5,633,623 | A | 5/1997 | Campman |
| 7,467,876 | B2 | 12/2008 | Segawa |
| 7,878,690 | B2 | 2/2011 | Kawato et al. |
| 8,690,380 | B2 | 4/2014 | Sato et al. |
| 8,944,624 | B2 | 2/2015 | Kim et al. |
| 8,998,448 | B2 | 4/2015 | Chang |
| 9,423,097 | B2 | 8/2016 | Haenen et al. |
| 9,476,566 | B2 | 10/2016 | Lu et al. |
| 9,822,951 | B2 | 11/2017 | Lu et al. |
| 2013/0176722 | A1 | 7/2013 | Lay et al. |

(Continued)

*Primary Examiner* — Anabel Ton

(74) *Attorney, Agent, or Firm* — Kilpatrick Townsend & Stockton LLP

(57) ABSTRACT

A minimally complex, low cost/economical luminaire that distributes point source light for general lighting applications, the luminaire having a substrate with a linear array of discrete light sources positioned to emit light into an air-filled cavity and a light redirecting assembly on the other side the air-filled cavity, the assembly comprising a clear, light transmissive rigid cover and a clear, light transmissive semi-rigid flexible film positioned between the cover and the substrate, wherein the film is non-adhesively secured within the luminaire and flexed to generally conform to the shape of the cover and wherein the surface of the film facing into the air-filled cavity comprises an array of optical relief structures extending into the air-filled cavity.

16 Claims, 10 Drawing Sheets

(56) References Cited

U.S. PATENT DOCUMENTS

| | | | | |
|---|---|---|---|---|
| 2015/0362132 | A1 | 12/2015 | McCane et al. | |
| 2016/0025905 | A1 | 1/2016 | Teather et al. | |
| 2017/0051895 | A1 | 2/2017 | Gielen et al. | |
| 2017/0268744 | A1* | 9/2017 | Hsia | F21V 5/04 |
| 2018/0328546 | A1 | 11/2018 | Xu et al. | |

* cited by examiner

LINEAR LIGHT EMITTING DIODE LUMINAIRES

CROSS REFERENCE TO RELATED APPLICATIONS

This application is a continuation application of U.S. patent application Ser. No. 15/441,940, filed on Feb. 24, 2017, the disclosure of which is incorporated by reference herein in its entirety.

BACKGROUND

Light emitting diodes (LEDs) are an energy efficient, highly reliable technology that is finding considerable utility in replacing fluorescent lamps in many lighting applications. Fluorescent lamps have become a less desirable source for energy efficient lighting applications since they emit light in 360 degrees. This makes it hard to efficiently direct all of the emitted light to the intended usable area of the lighting application. However, while LEDs are more energy efficient, they present their own design challenges for lighting applications. Specifically, LEDs are point sources as opposed to continuous/extended sources of light. This concentration of point source light needs to be evenly dispersed and distributed across the intended usable area for the lighting application. In addition, since LEDs are point sources requiring dispersion in lighting applications, dispersed LED light will travel across a wide range of angles that will either be: (1) absorbed within the luminaire and create efficiency loss; (2) redirected out of the luminaire but beyond the intended usable area; (3) redirected out of the luminaire but unevenly distributed in the intended usable area, or (4) redirected out of the luminaire and evenly distributed across the intended usable area. Therefore, there are difficult design challenges to properly dispersing light from a row of LEDs into a useful and efficient light distribution. LED luminaire designs that fail to achieve even dispersion and distribution across the intended usable area, and fail to account for the wide range of angles for emitted light, will yield poor performance, including unacceptable glare and poor aesthetics in those lighting applications.

A need exists for a low cost luminaire configuration that efficiently redistributes the point source illumination from LEDs into a light output distribution superior to the inefficient distribution achieved with fluorescent lamps and existing LED luminaires. Specifically, there is a need for a new and more efficient luminaire that offers an even distribution of luminance across its luminous surface, evenly distributes light over a wide footprint below the luminaire, and for which the form factor and conformal geometry of the luminaire is similar to what was designed for traditional/conventional fluorescent lamps.

SUMMARY OF THE INVENTION

It would be desirable to have a minimally complex, low cost/economical means of providing for the distribution of point source light, for example an array of LEDs, from a luminaire intended for a general lighting application, wherein the physical structures and components of the luminaire are relatively easy to manufacture with low-cost materials and are relatively easily to assemble to create a relatively low cost, energy efficient and aesthetically pleasing functional luminaire.

In one aspect of the embodiments, a luminaire is disclosed comprising: a substrate having a length; a light redirecting assembly comprising: a clear, light transmissive, semi-rigid, flexible film extending the length of the substrate, a clear, light transmissive cover extending the length of the substrate and comprising: one or more locations at which the film may be held in place proximate to the cover and which holding allows the film to approximately conform to the shape of the cover; an air-filled cavity defined by the substrate and by the light redirecting assembly; a linear array of discrete light sources positioned so as to emit light into the cavity, wherein the array of discrete light sources is affixed to the surface of the substrate facing into the air-filled cavity and extends along the length of the substrate; an electronic control for activating and powering the discrete light sources to emit light; an electrical connection between the discrete light sources and the electronic control for activating and powering the discrete light sources, and wherein the surface of the clear, light transmissive, semi-rigid, flexible film facing into the air-filled cavity comprises: an array of optical relief structures extending into the air-filled cavity.

In a further aspect of the embodiments, the discrete light sources of the disclosed luminaire are light emitting diodes and the optical relief structures are selected from the following list of structures: V groove, isosceles triangular groove, right triangular groove, acute triangular groove, pyramid, square pyramid, square right pyramid, rectangular pyramid, rectangular right pyramid, rhombic pyramid, or polygonal pyramid. In addition, the optical relief structures may have at least two opposing sides and may have a base and may have angles between faces on the two opposite sides of the structures and the base of the structure that are different from each other, and those angles may vary from structure to structure over at least a portion of the surface of the film. In addition, the angles between the faces on the two opposite sides of a structure and the base of the structure may vary from structure to structure over at least a portion of the surface of the film. In addition, the dimensions of the sides of the bases of the structures may vary from structure to structure over at least a portion of the surface of the film. In addition, the heights of the optical relief structures may vary from structure to structure over at least a portion of the surface of the film. In addition, the heights of the optical relief structures may be between 5 and 200 microns, and most preferably between 20 and 40 microns. In addition, where the optical relief structures have a base with sides, the sides of the bases of the optical relief structures may be between 5 and 200 microns in length, and most preferably between 20 and 40 microns in length.

In a further aspect of the embodiments, the film of the luminaire may have surface topology facing into the cavity that comprises an array of grooves that are separated by ridges having triangular cross-sections, wherein in some sections of the surface topology the triangular cross-sections of the ridges have the shape of right triangles and in other sections of the surface topology the ridges have the shape of isosceles triangles. And in a still further aspect, two sections of the surface topology having ridges with cross-sections having the shape of right triangles may lie adjacent to and on opposite sides of the central axis of the film, and wherein the vertical sides of the right triangular cross-sections are oriented towards the central axis. In addition, the right triangular shapes of the cross-sections of the ridges may vary across the sections with the angles of the triangular shapes opposite their vertical sides and may increase with increasing distance from the central axis. Further, in addition to the sections of the surface topology having ridges with cross-sections having the shape of right triangles, there may be two additional sections of the surface topology having ridges with cross-sections having the shape of isosceles triangles which lie adjacent to the two sections having ridges with cross-sections having the shape of right triangles. In addition, the angles of the triangular shapes opposite their vertical sides may increase from 30 degrees to 50 degrees. In addition, the four sections of the surface topology may be equal in area and the cross-sections having the shape of isosceles triangles may have apex angles of 98 degrees. Where the optical relief structures are a series of grooves with triangular cross-sections, the heights of the triangular cross-sections of the grooves may be between 5 and 500 microns, or more preferably between 20 and 40 microns, and such heights may vary across at least a portion of the surface of the film; and the widths of the grooves may be between 5 and 200 microns, or more preferably, between 20 and 40 microns; and such widths may vary across at least a portion of the surface of the film.

In a further aspect of the embodiments, the shape of the cover of the disclosed luminaire may be that of half of a hollow cylinder and further, the edges of the cylindrical cover—along which the shape would be cut from a full hollow cylinder—may be attached to the substrate to define the air-filled cavity of the luminaire. Specifically, the shape of the cover of the disclosed luminaire may be one of the following: half of a hollow circular cylinder, half of a hollow elliptic cylinder, half of a hollow parabolic cylinder. In addition, the luminaire may further comprise a diffuse white reflector that is coated, adhered to, or attached to the surface of the substrate that faces into the air-filled cavity. In addition, the cover may incorporate a light diffusing material, which may be adhered or otherwise affixed to a surface of the light transmissive cover. In addition, the array of optical relief structures extending into the air-filled cavity may cover the entire surface of the clear, light transmissive, semi-rigid, flexible film.

BRIEF DESCRIPTION OF THE DRAWINGS

The novel features of the aspects described herein are set forth with particularity in the appended claims. The aspects, however, both as to organization and methods of operation may be further understood by reference to the following description, taken in conjunction with the accompanying drawings.

DETAILED DESCRIPTION

We have now devised simple and relatively inexpensive luminaire designs that redistribute the light from a row of LEDs into a continuous bar of light of relatively uniform luminance and then disperses that light in a desirable distribution with a high energy efficiency.

Figure 1A:
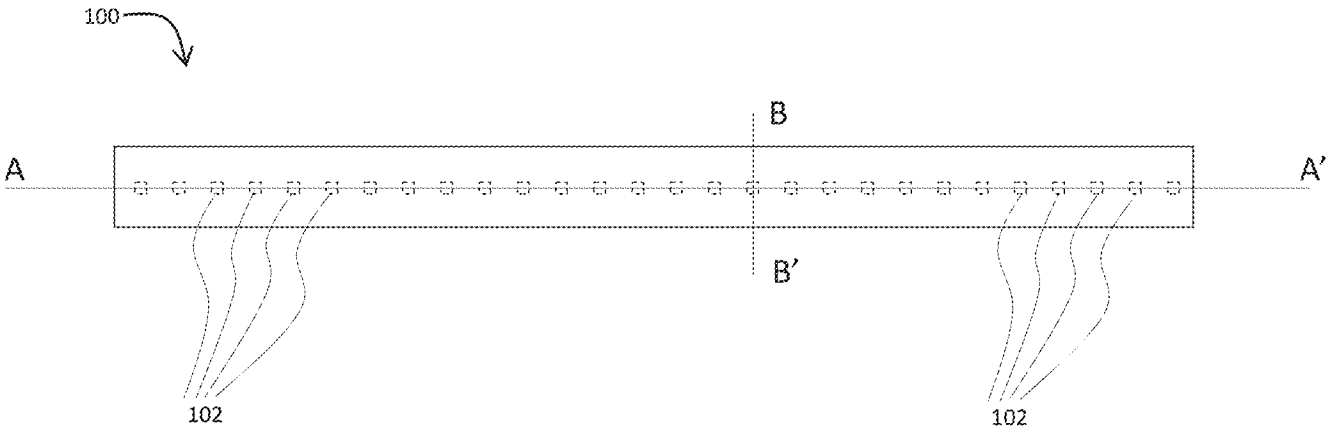
FIG. 1A illustrates a planar view of an example luminaire designating an A-A' axis and a B-B' axis.
Figure 1B:
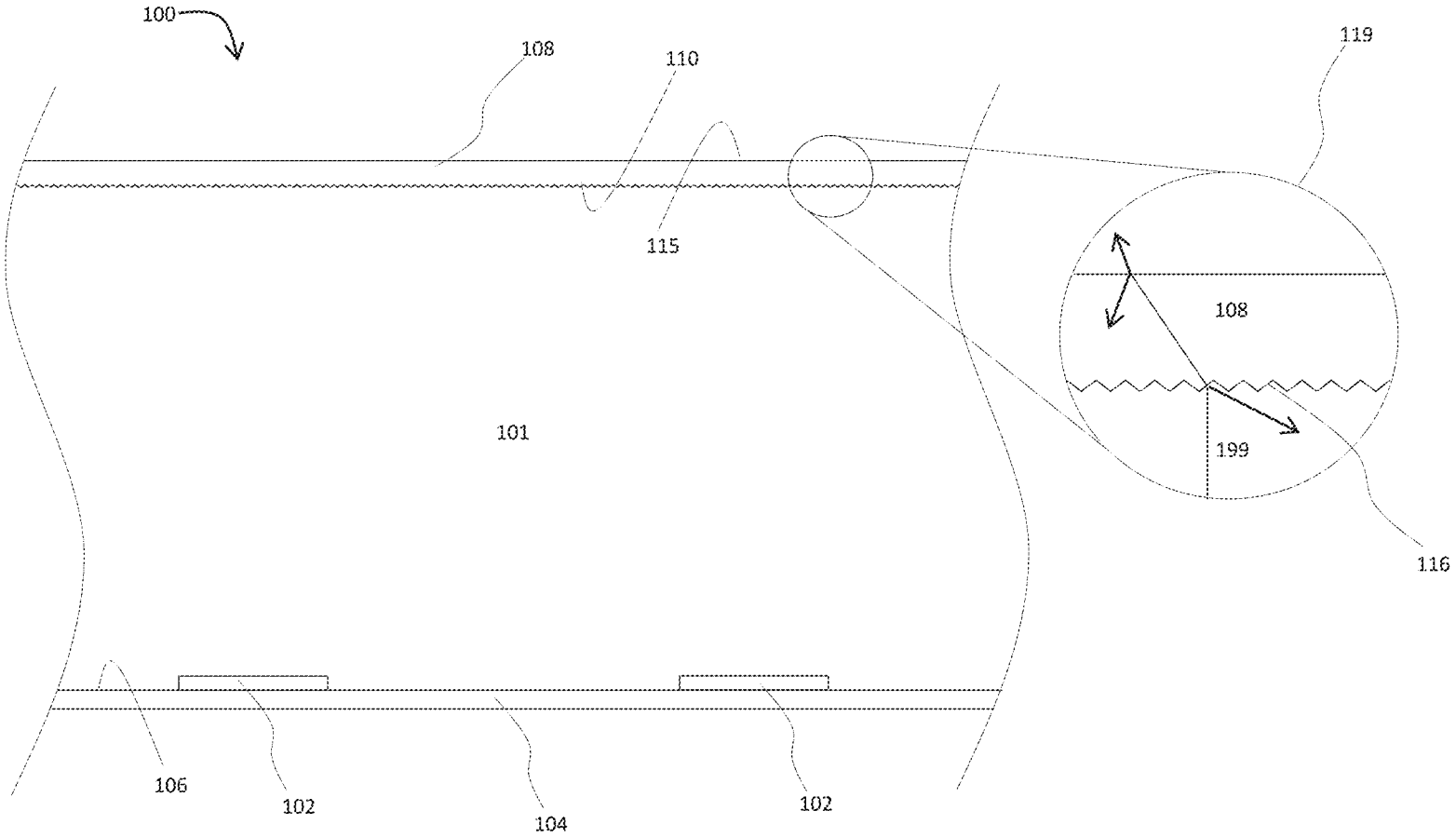
FIG. 1B illustrates a cross sectional view of the luminaire of FIG. 1A along the A-A' axis.
Figure 1C:
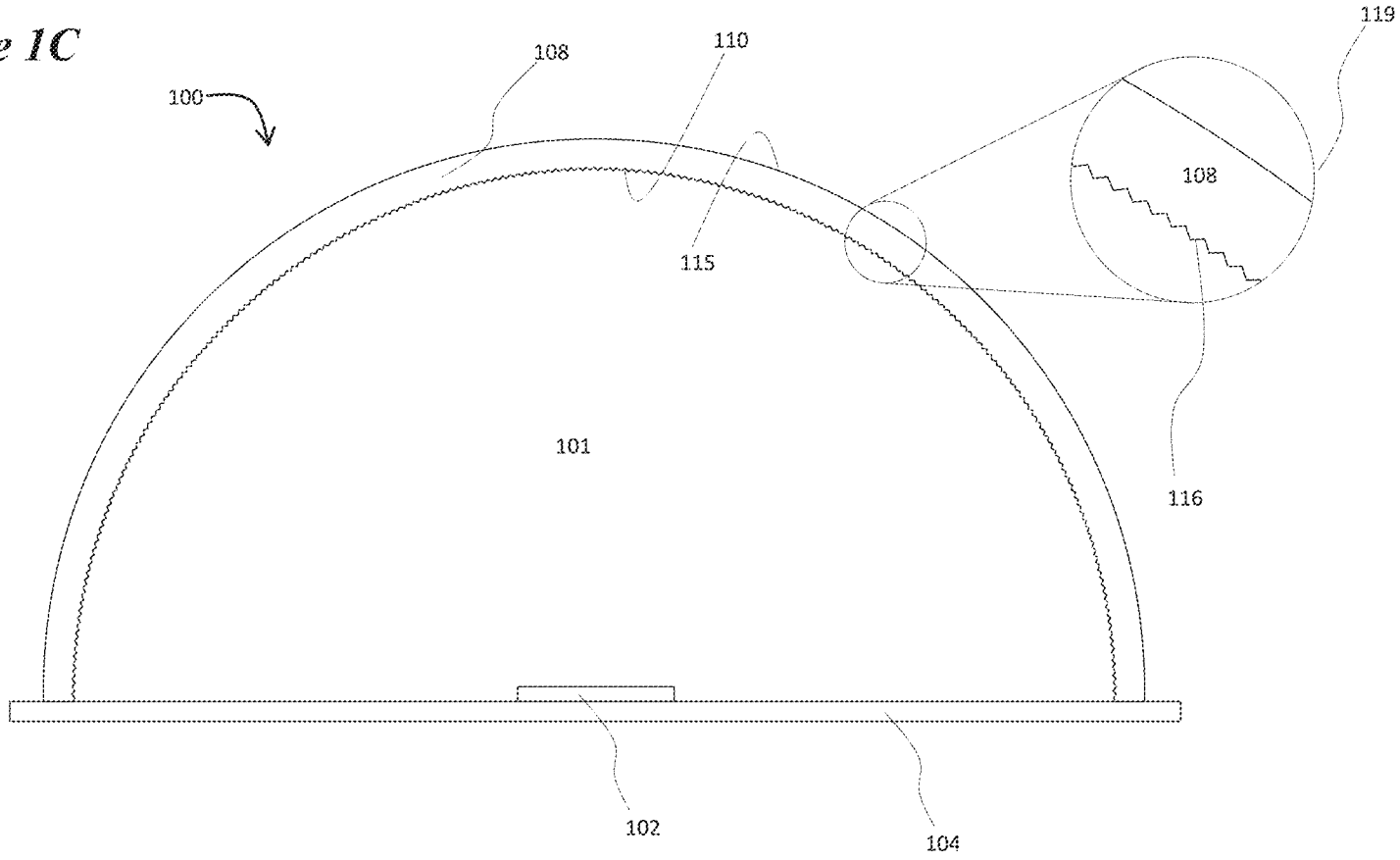
FIG. 1C illustrates a cross sectional view of the luminaire of FIG. 1A along the B-B' axis.

The device 100 depicted in FIGS. 1A, 1B, and 1C illustrates the general nature of the invention, but also illustrates an issue with regard to its implementation. FIG. 1A depicts the luminaire in a plan view with the location of the row of LEDs 102 interior to the luminaire illustrated. FIG. 1B depicts a cross-sectional view of a segment of the luminaire along axis A-A' that is shown in FIG. 1A. LEDs 102 are mounted or attached to substrate 104. This substrate may be a printed circuit board, a flexible plastic tape, or the case that encloses the luminaire. In any case the substrate provides the electrical interconnections that connect the LEDs to drive electronics (not shown). Surface 106 of substrate 104 may have a white, highly reflective material coated, mounted or adhered to it. Clear, light transmissive cover 108, which be formed from a polymeric material, is mounted over LEDs 102 and substrate 104. Suitable polymeric materials may include, for example, polyethyleneterephthalate (PET) or polymethyl methacrylate (PMMA), as well as other transparent and translucent polymers. Incorporated herein by reference is U.S. patent application Ser. No. 14/740,227, published as US2016/0025905, which identifies additional light-transmissive materials that may be used for light diffusion applications. Air-filled space or cavity 101 lies between cover 108 and substrate 104. Inward facing surface 110 of cover 108 has a sawtooth topology 116 when viewed from the angle shown in FIG. 1B. The profile of this topology 116 is more clearly seen in magnified inset 119.

The exemplary sawtooth topology 116 is but one example or means to describe the geometric structures intended to influence the reflection and transmission of light to achieve a preferred light distribution pattern. These geometric structures are sometimes referred to as optical relief structures or optics and are generally deployed in an array across the entire surface of the polymeric material. Or, as disclosed in U.S. Pat. No. 7,878,690, the array may be characterized as a microlens or prism lens array. Suitable optical relief structures may include V groove-, isosceles triangular groove-, right triangular groove-, acute triangular groove-, pyramid-, square pyramid-, square right pyramid, rectangular pyramid-, rectangular right pyramid-, rhombic pyramid-, or polygonal pyramid-like structures.

Figure 2:
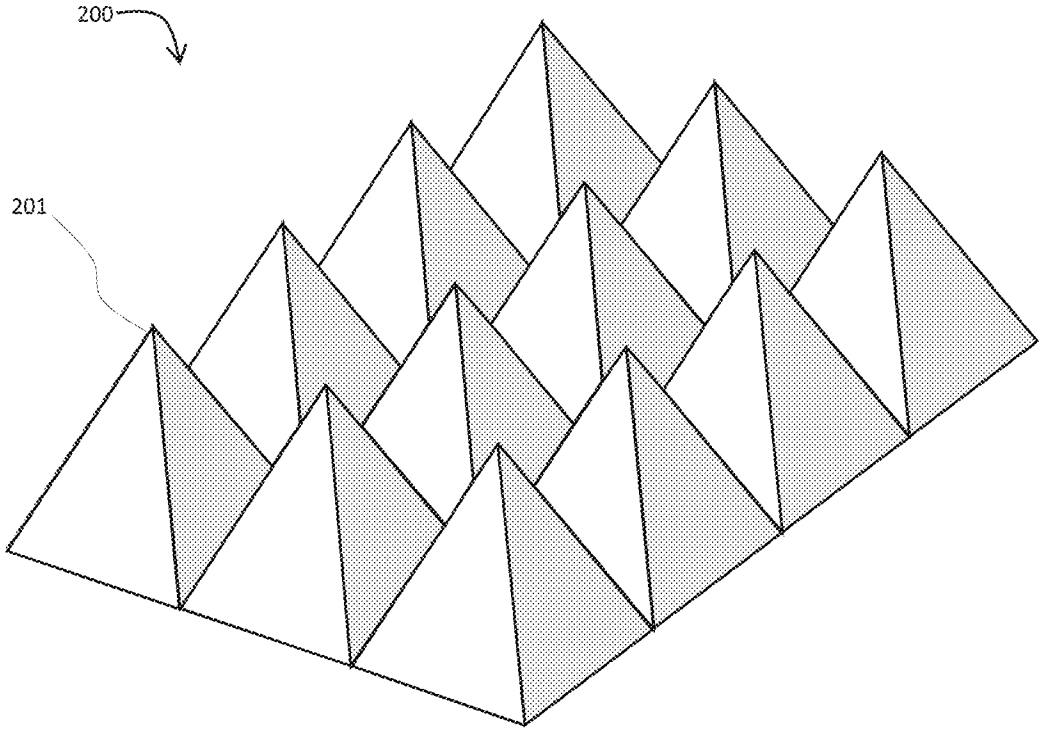
FIG. 2 illustrates a small segment of an array of pyramidal protrusions in an example luminaire.

FIG. 1C depicts a cross-sectional view of the luminaire along axis B-B' that is shown in FIG. 1A. In this view, clear, light transmissive cover 108 is seen to have the shape of a half of a hollow circular cylinder. Topology 116 of inward facing surface 110 of cover 108 also appears to have a sawtooth profile in magnified inset 119 when viewed from the angle shown in FIG. 1C. Based on the two views of surface topology 116 shown in FIGS. 1B and 1C it can be seen that the entire inward facing surface 110 of cover 108 is covered with an array of protrusions in the shape of a square right pyramid 201. A small segment 200 of such an array is depicted in FIG. 2.

When light is emitted from LEDs 102 in luminaire 100, the light will strike one of the faces of the pyramidal protrusions. For example, as shown in FIG. 1B, light ray 199 strikes a face of one of the pyramidal protrusion 201 extending within the sawtooth topology 116 from the inward facing surface 110 of cover 108. In passing from the low refractive index medium (air in cavity 101) into the higher refractive index medium of clear cover 108 the light ray 199 is partially transmitted and partially reflected. The transmitted component of light ray 199 is altered in its path on passing through the refractive index interface and strikes outer surface 115 of cover 108 where it will once again be partially transmitted and partially reflected. The reflected component of light ray 199 strikes another face of another pyramidal protrusion and is once again partially transmitted and partially reflected. In this manner through a whole series of partial transmissions and partial reflections of light striking and passing through the faces that make up the topology of surface 110, the path of light exiting luminaire 100 will spread out widely over a range of angles and range of locations on outward facing surface 115. The portion of light reflected back down into cavity 101 will strike the white reflective surface of substrate 106 and be re-reflected back up and out through cover 108 in the manner described above. Optical modeling of the luminaire configuration 100 shows it perform excellently in terms of providing uniform light output across the luminaire surface and in providing a uniform lighting footprint under luminaire 100. This is accomplished with little loss in energy efficiency.

Figure 3:
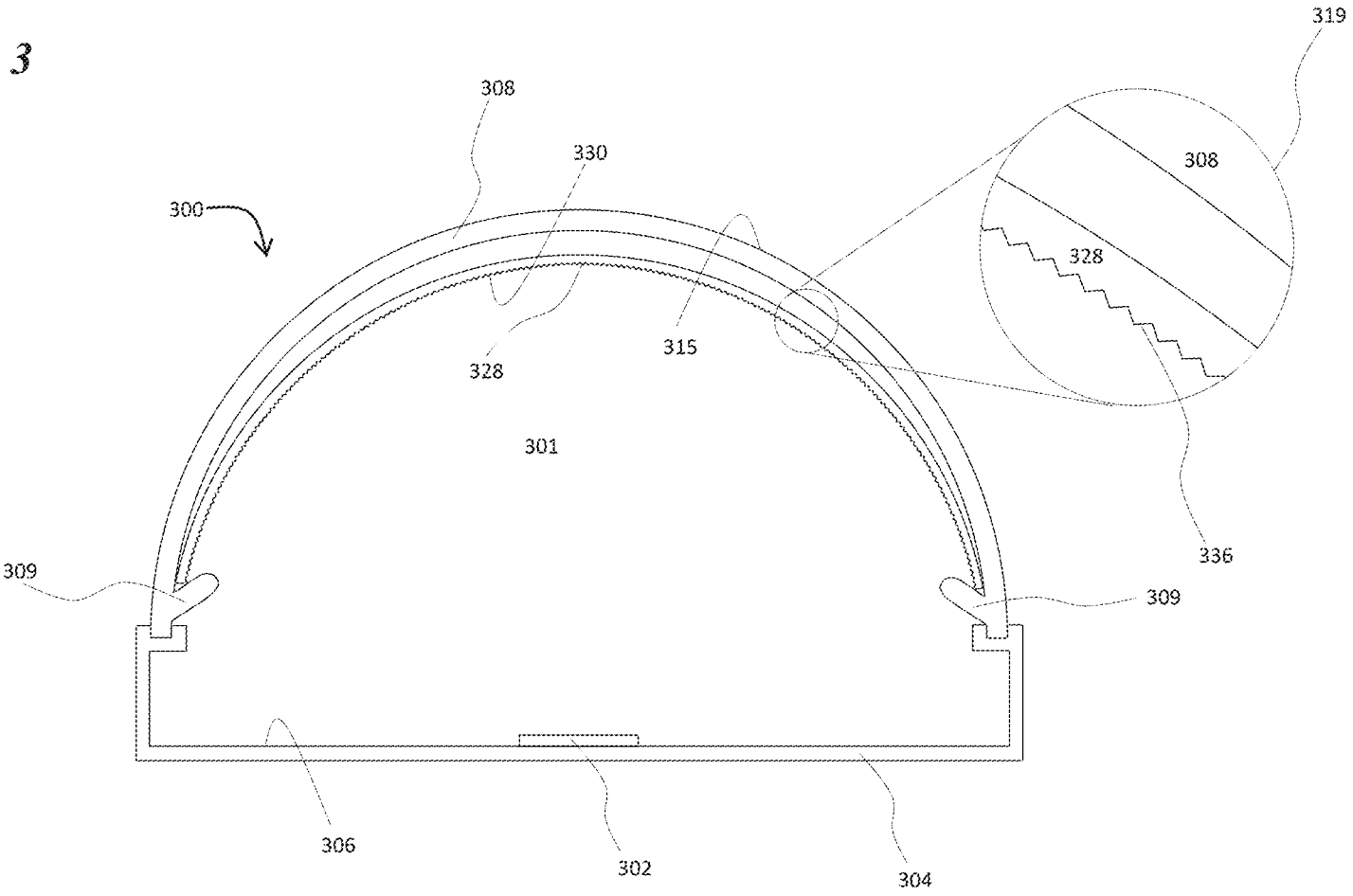
FIG. 3 illustrates a cross sectional view of another embodiment of the luminaire of FIG. 1A along the B-B'.

There is, however, a serious design consideration in the construction of luminaire 100. The three dimensional structure of cover 108 with its array of pyramidal protrusions 116 makes it extremely difficult if not impossible to extrusion mold a polymer into such a part because it may not release from the mold. FIG. 3 depicts an embodiment 300 to the invention that addresses this release problem for many useful luminaire designs. A line of LEDs 302 (one shown) is mounted on case 304 that may have a white reflective material coated, attached, or adhered to its inner surface 306. A clear, light transmissive cover 308 in the shape of a hollow cylinder is mounted on case 304. A flexible, but semi-rigid film 328 of clear, transparent material is captured by projections 309 from cover 308 so as hold it securely in place and induce a curvature in film 328 so that it generally or roughly conforms to the inner surface of cover 308 as shown in FIG. 3. The inner surface 330 of film 328 is shown in magnified detail in inset 319. Surface 330 of film 328 has a surface topology 336 of an array of square right pyramids 201 similar to topology 116 in FIGS. 1B and 1C. Film 328 functions optically in a manner similar to cover 108 in example 100. The films 328 utilized to produce embodiment 300 may be produced by embossing, stamping, or compression molding the pyramidal structures onto the surface of a film. While clear cover 308 and captured film 328 in this embodiment are semi-circular in in shape, in other embodiments they may be elliptical in shape or have some other curved shape. Cover 308 may optionally contain a light diffusing material or cover 308 may have a light diffusing film adhered or attached to its inner or outer surface.

A flexible sheet with a surface topology similar to topography 336 of film 328 may optionally be adhered or otherwise affixed to the inner surface of cover 308 in lieu of utilizing some means of capturing film 328. The surface topology similar to 336 would, again, face inward into cavity 301.

Figure 5:
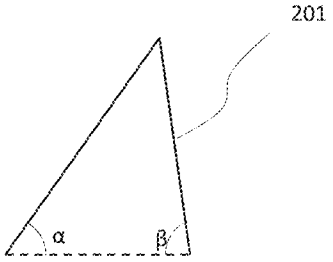
FIG. 5 illustrates another possible geometric representation of a pyramidal protrusion of a luminaire.
Figure 6:
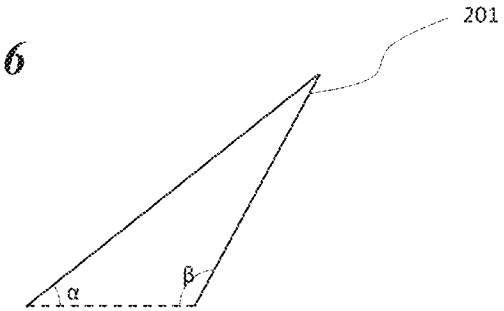
FIG. 6 illustrates another possible geometric representation of a pyramidal protrusion of a luminaire.

A further embodiment of the invention may be explained with reference to FIG. 4. The cross-sections (for instance along axis A-A' in FIG. 1A) of two pyramidal protrusions 201, which may be from inward facing surface 110 of cover 108 or from inner surface 330 of film 328 (for a luminaire 100 or 300), are shown for an exemplary embodiment in FIG. 4. The pyramids have a height h and a base width b. The pyramids also have base angles $\alpha$ and $\beta$, and have apex angles $\gamma$. The angle between the faces of two adjacent pyramids is $\delta$. The height h and base width b of these pyramidal structures may be between 5 and 200 microns with heights and base widths of 20 to 40 microns preferred. In the embodiments described so far, the pyramidal structures are in the shape of square pyramids, however, embodiments in which the surface topology 336 comprises rectangular pyramids or rhombic pyramids are possible and may be preferred in some applications. The faces of pyramids 201 may also have some curvature. In the embodiments described so far the base angles $\alpha$ and $\beta$ have the same value. However, in some embodiments it may be advantageous for one base angle to be greater than the other. FIG. 5 illustrates the cross-section of pyramid 201 with a pyramidal structure (an acute pyramid) in which base angle $\beta$ is greater than base angle $\alpha$, but both angles are less than or equal to ninety degrees. FIG. 6 illustrates the cross-section of pyramid 201 with a pyramidal structure (an obtuse pyramid) in which one base angle $\beta$ is greater than ninety degrees.

The configurations of the pyramidal structures that may be practically or cost effectively used on cover 108 or film 328 are constrained by the fabrication processes used to produce the cover or film. The angle $\delta$ between the faces of adjacent pyramids cannot be made to be too small because of the constraints of the diamond turning process used to fabricate the tooling used in the embossing or molding process. Acute pyramidal structures may be formed on the surface of cover 108 or film 328, but an inner surface with obtuse pyramidal structures cannot be practically produced by the embossing or compression molding techniques.

In embodiments similar to exemplary embodiments 100 and 300, it is often advantageous to vary the configurations of the pyramidal structures on the inner surface 110 of cover 108, or inner surface 330 of film 328, across the cross-sections shown in FIG. 1C and FIG. 3 outward from the center of cover 180, or film 328, towards the cover or film edges. In particular it may be advantageous to gradually vary the base angles $\alpha$ and $\beta$ of the pyramidal structures on the surface of the cover or film from equal values at the center of the cover or film to pyramidal structures with larger base angles on the pyramidal sides towards the edge of the cover or film and smaller base angles on the pyramidal sides towards the center of the cover or film. The heights h and base widths b of the pyramidal structures may also be gradually varied as the pyramidal structures progress towards the edge.

In some embodiments of the invention sufficiently improved optical performance may be obtained by utilizing a flexible, but semi-rigid film similar to 328, but in this case the surface topology of the film has a profile that is unchanging along the an axis running the length of the luminaire (that is to say, along an axis analogous to axis A-A' in FIG. 1A) while having a sawtooth profile in the view shown in FIG. 3. Thus, the inward facing surface 330 of film 328 is seen to be covered with a series of grooves with triangular profiles.

Figure 4:
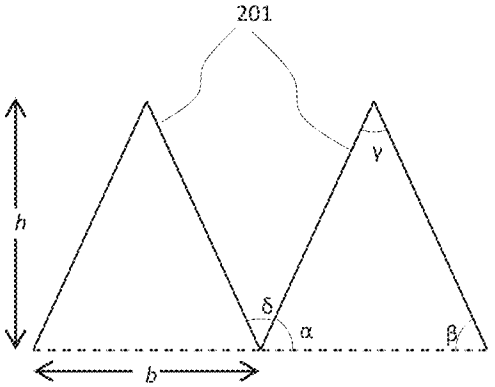
FIG. 4 illustrates a possible geometric representation of pyramidal protrusions of a luminaire.

When viewed from the direction of FIG. 3, the profiles of these grooves will appear to be the same as is shown for the pyramidal cross-sections in FIG. 4 with base angles $\alpha$ and $\beta$, angles between the sides of two adjacent triangular cross-sections $\delta$, and heights h and base widths b. The constraints on these parameters for the triangular cross-sections of the grooves in these embodiments are much the same due to the limitations of embossing and compression molding as was the case for the pyramidal surface profiles above. Surface topologies with grooves having acute triangular profiles (similar to the pyramid cross-section in FIG. 5) or triangular profiles similar to isosceles triangles can be utilized, but surface topologies utilizing obtuse triangular profiles (similar to the pyramid cross-section in FIG. 6) cannot be used.

Figure 7:
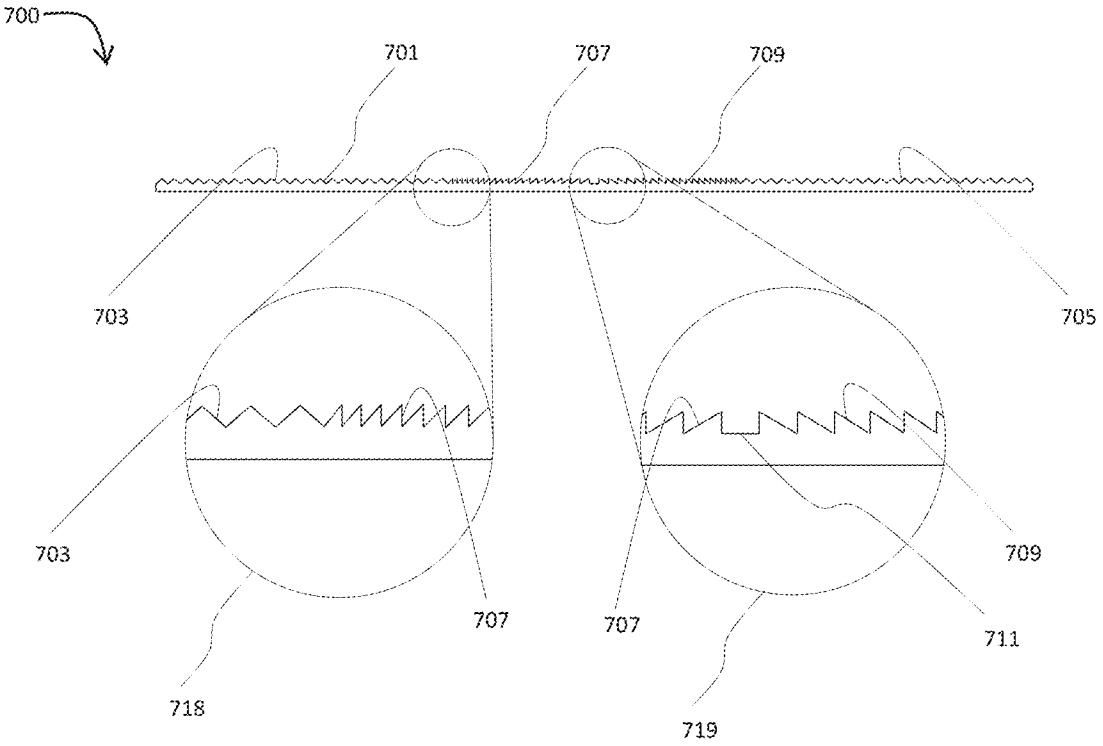
FIG. 7 illustrates a cross sectional view of optical relief structures on the film or cover layer of a luminaire.

In embodiments having the grooved surface profiles on the inward facing surface of films similar to 328, it is often advantageous to vary the configurations of the triangular grooves on the inward facing surface (similar to 330) of the films across the cross-sections like those shown in FIG. 3 outward from the center of the film 328 towards the film edges. A particularly useful set of embodiments may be assembled by substituting flexible, but semi-rigid films having surface topologies similar to film 700 depicted in cross-section in FIG. 7 for film 328 in embodiment 300. In film 700 the surface topology 701 may be divided into sections that have different cross-sectional profiles for topology 701. The structure of these four sections may be more clearly seen in magnified insets 718 and 719. The sections 703 and 705 of the surface topology that are adjacent to the edges of film 700 away from its central axis 711 have a constant profile with the ridges between the grooves in the film's surface having the profiles of isosceles triangles. Sections 707 and 709, which are adjacent to central axis 711 of film 700, have a surface profile in which the ridges between the grooves have the profiles of right triangles with one base angle being a right angle. In each of these sections the right angle base angles of the triangular cross-sections of the ridges between the grooves lie towards central axis 711 of film 700. In each of sections 707 and 709 the non-right angle base angles of the triangular cross-sections between the grooves gradually increase moving away from central axis 711. In the embodiment shown in FIG. 7, the non-right angle base angles of the triangular cross-sections of the ridges between the grooves in sections 707 and 709 gradually increase from 30 degrees to 50 degrees, but the range of these angles may be tuned so as to tune the angular light distribution exiting the luminaire. Similarly, the base angles of the isosceles triangular cross-sections of the ridges between the grooves in sections 703 and 705 may be varied from the 41 degree angle of the embodiment in FIG. 7. The heights h of the triangular ridges between the grooves in surface topology 701 do not vary across the width of film 700, but may do so in other embodiments. The base widths of the triangular cross-sections of these ridges do vary across the width of film 700 and may show a different variation in other embodiments. The ratios of the widths of sections 703, 705, 707, and 709 one to the other may be varied from those depicted in FIG. 7.

To fabricate a luminaire similar to embodiment 300 shown in FIG. 3, flexible, but semi-rigid film 700 is bent and inserted into a position adjacent to a clear cover similar to 308 in FIG. 3 and with its outside edges captured by projections similar to projections 309. The curvature assumed by film 700 in this configuration and by film 328 in luminaire 300 greatly influence the angular distribution of light emitted by the luminaires produced. Thus, the shape of the curvature of clear cover 308, its radius of curvature, and the degree to which films 700 or 328 conform to this curvature may be adjusted in the design of the luminaires to achieve the desired distribution of light output.

Figure 8A:
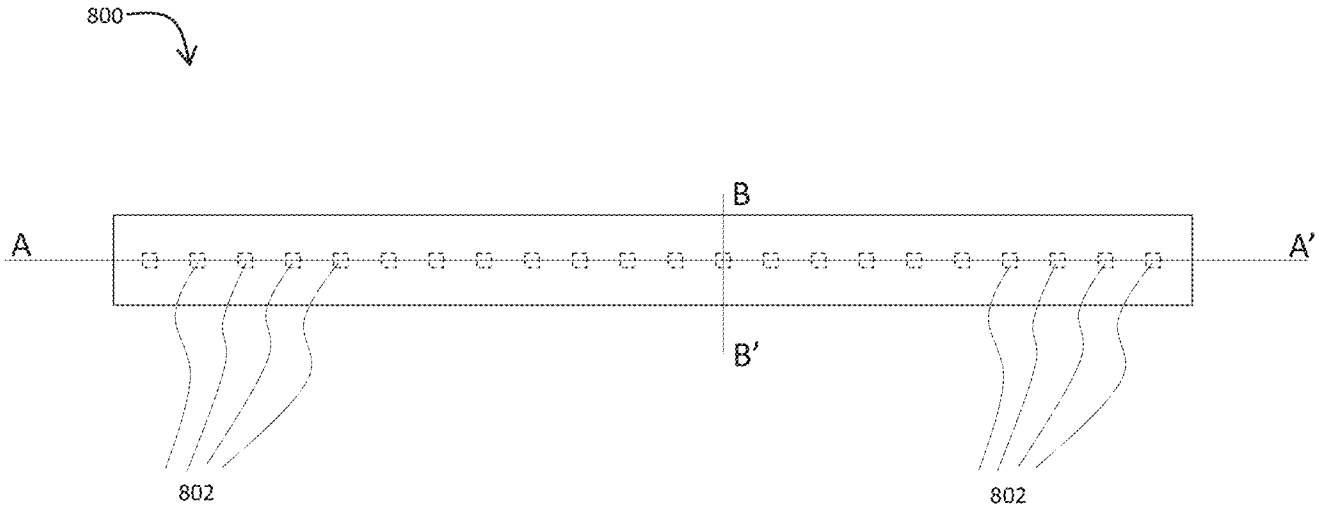
FIG. 8A illustrates a planar view of another example luminaire designating an A-A' axis and a B-B' axis.
Figure 8B:
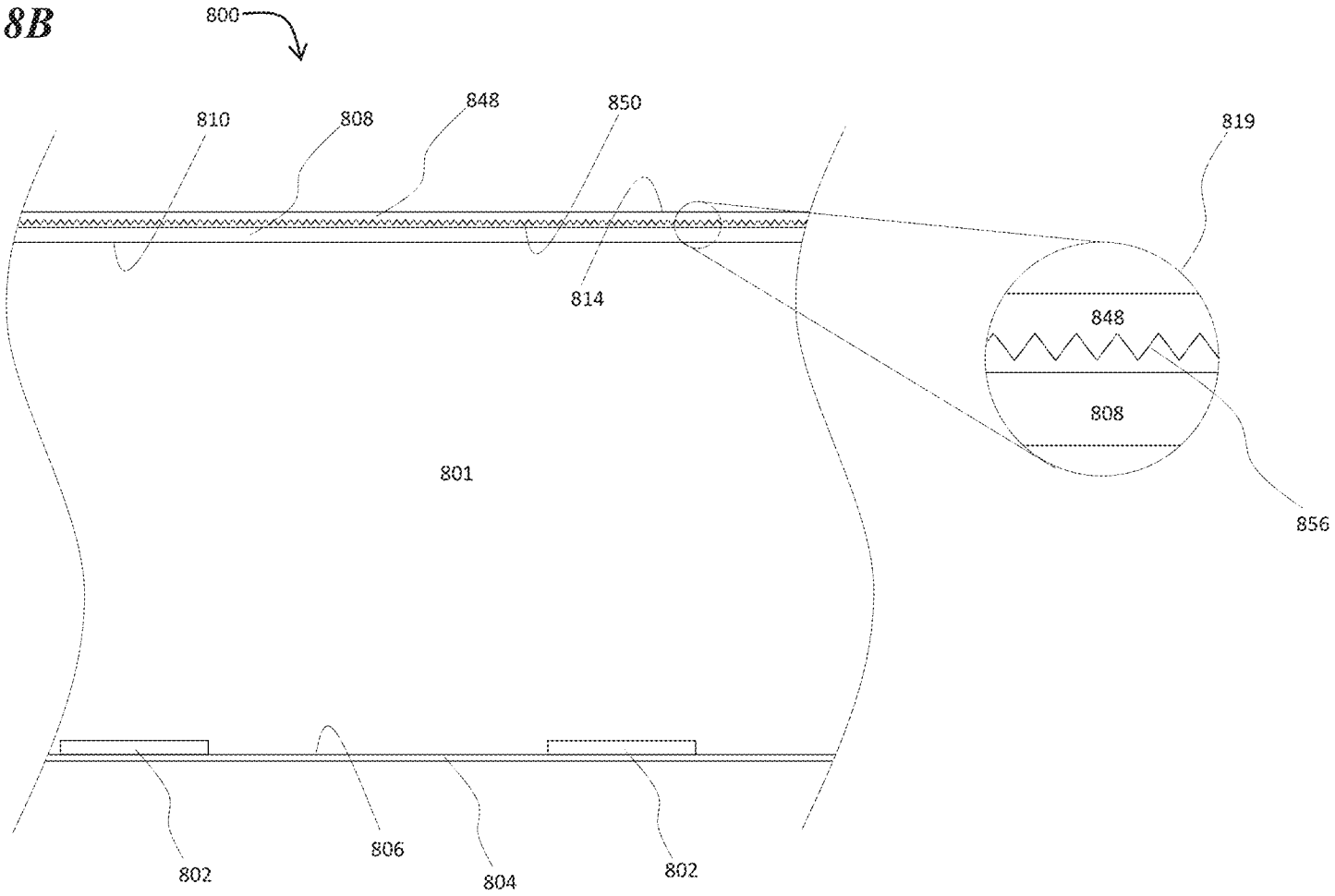
FIG. 8B illustrates a cross sectional view of the luminaire of FIG. 8A along the A-A' axis.
Figure 8C:
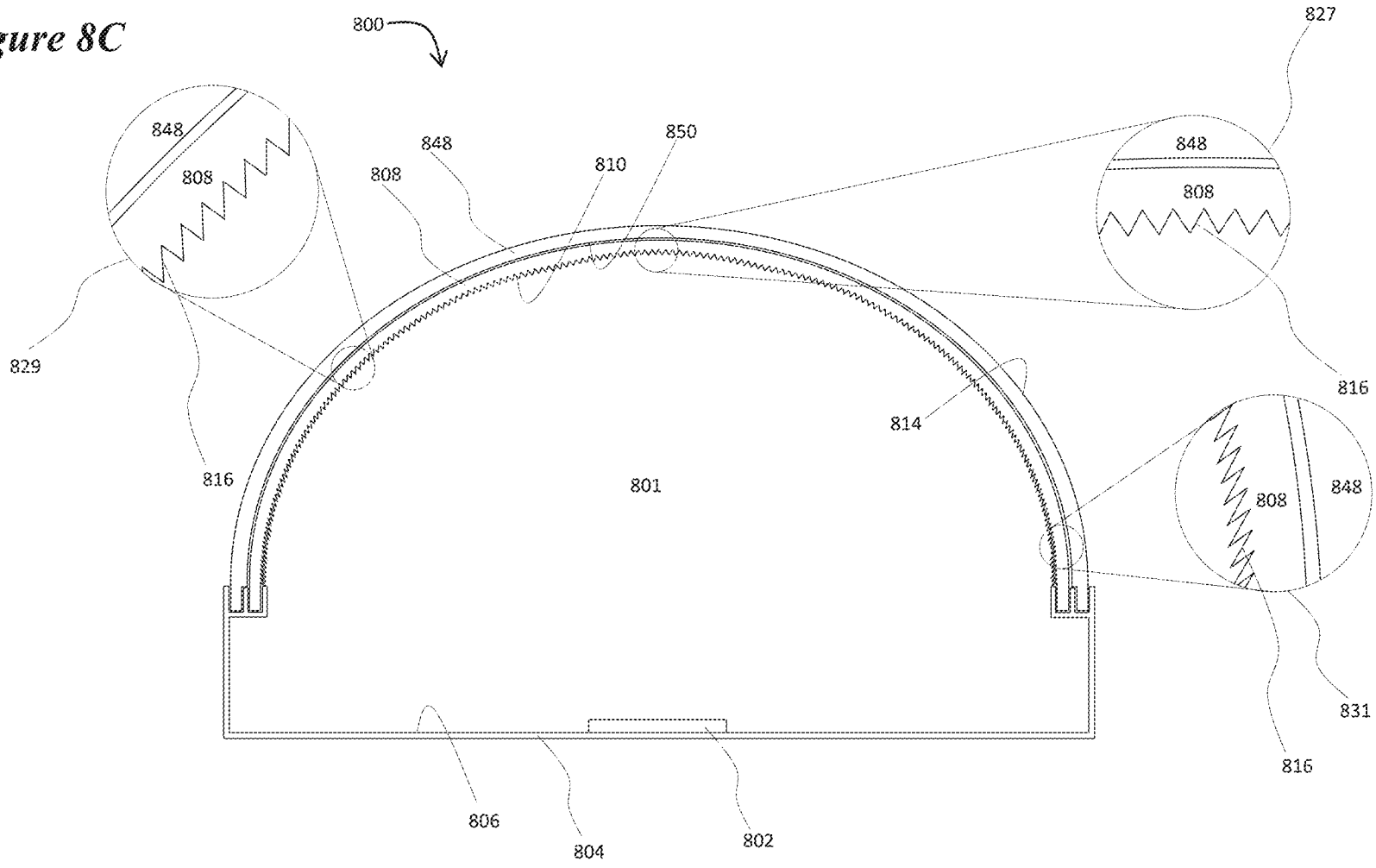
FIG. 8C illustrates a cross sectional view of the luminaire of FIG. 8A along the B-B' axis.

FIGS. 8A, 8B, and 8C depict luminaire 800, which is another exemplary embodiment of the invention. FIG. 8A depicts a plan view of luminaire 800 with the location of the row of LEDs 802 interior to luminaire 800. FIG. 8B depicts a cross-sectional view of a segment of luminaire 800 along axis A-A' that is shown in FIG. 8A. LEDs 802 are mounted or attached to case 804. The case provides the electrical interconnections that connect LEDs 802 to drive electronics (not shown). Surface 806 of substrate 804 may have a white highly reflective material coated, mounted or adhered to it. Clear, light transmissive cover layer 808 is mounted over LEDs 802 and substrate 804. Air-filled space 801 lies between cover layer 808 and substrate 804. From the point of view in FIG. 8B the topology of inner surface 810 of cover 808 is unchanging as the surface progresses along the A-A' axis. A second clear, light transmissive cover layer 848 overlays and conforms approximately to cover layer 808. Inward facing surface 850 of cover layer 848 has a sawtooth topology 856 when viewed from the angle shown in FIG. 8B. The profile of this topology 856 is more clearly seen in magnified inset 819.

FIG. 8C depicts a cross-sectional view of the luminaire along axis B-B' that is shown in FIG. 8A. In this view, clear, light transmissive covers 808 and 848 are seen to have the shapes of halves of hollow elliptic cylinders. Topology 816 of inward facing surface 810 of cover layer 808 has a sawtooth profile in magnified insets 827, 829, and 831 when viewed from the angle shown in FIG. 8C. However, these three insets show that the shape of the triangular structures that make up the sawtooth profile progresses from isosceles triangles at the center of cover layer 808 (inset 827) gradually to acute triangles with progressively different base angles (inset 829) to obtuse triangles with one base angle over 90 degrees (inset 831) nearer the edges of cover layer 808. It can be seen that each of the cover layers has its inward facing surface covered with a series of grooves with triangular profiles. Light striking the structure of inward facing surface 810 of cover layer 808 undergoes the same sort of reflection and transmission pictured for light ray 199 in FIG. 1B. This reflection and transmission occurs only in the plane parallel to B-B' in FIG. 8A. Similarly, light striking the structure of inward facing surface of cover layer 848 undergoes the same sort of reflection and transmission pictured for light ray 199 in FIG. 1B. This reflection and transmission occurs only in the plane parallel to A-A' in FIG. 8A. The combination of the transmissions and reflections in both layers 808 and 848 act together in a manner similar to the pyramidal structures in embodiment 300.

The profile 816 of surface 810 of cover layer 808 in embodiment 800 contains obtuse triangular structures that could not be produced in a film by embossing or compression molding. But, since the surface profile extends along only one axis of cover layer 808, this part may be produced by an extrusion process. Cover layer 848 may be a film with the embossed or compression molded surface topology 856 layered over cover layer 808. In other embodiments cover layers 808 and 848 may exchange places in the structure of a luminaire like luminaire 800. In such a case the outer cover layer (that has a surface topology like 816 in FIG. 8C) may have a structure, like that of 308 in embodiment 300 above, that captures a flexible, semi-rigid film that functions as the inner cover layer (with a surface topology like 856 in FIG. 8B).

Embodiments that use two semi-rigid films of clear, transparent material with two orthogonal sets of grooves to replace and function in a similar manner to rigid cover layers 808 and 848 and in which the semi-rigid films are captured by projections from a clear cover similar to 308 in embodiment 300 above are possible so long as the films' surface topologies are capable of being embossed or compression molded. That is to say, films in such embodiments cannot have sawtooth cross-sectional profiles that involve obtuse triangular structures or possibly very steep-sided acute triangular structures.

The embodiments described above are illustrative examples and it should not be construed that the present invention is limited to these particular embodiments. For example, although LED devices were used as examples of discrete light sources, other light emitting devices may be used. Further, although the orientation of components in the embodiments were described as being parallel to or running the length of other components, it should be understood that they need not be exactly parallel or running exactly the length, rather in a close range of being normal or substantially normal or in a close range of running the length. Further, various components and aspects described with reference to different embodiments are interchangeable among different embodiments, and are not limited to one particular embodiment. Thus, various changes and modifications may be effected by one skilled in the art without departing from the spirit or scope of the invention as defined in the appended claims.

The drawings illustrating the embodiments of this patent illustrate objects of greatly varying size. The relative sizes and numbers of various objects as portrayed in the drawings have been modified for the sake of clarity and completeness. Therefore, the relative size and number of objects in the drawings should not be taken as accurate in terms of size or extent relative to other objects.

While the present invention has been particularly shown and described with reference to example embodiments thereof, it will be understood by those of ordinary skill in the art that various changes in form and details may be made therein without departing from the spirit and scope of the present invention as defined by the following claims and equivalents thereof. It is therefore desired that the present embodiments be considered in all respects as illustrative and not restrictive, reference being made to the appended claims and equivalents thereof rather than the foregoing description to indicate the scope of the invention.

What is claimed is:

1. A luminaire, which may be oriented in any direction, having a relative top and bottom and short-side axis and long-side axis, comprising:

a substrate located near the top of the luminaire and having a length extending linearly along the long-side axis;

a light redirecting assembly located within the luminaire, comprising a clear, light transmissive, semi-rigid, flexible film having a length extending linearly along the long-side axis, wherein the film is flexed to allow the film to be non-adhesively secured near an outer edge of the short-side axis of the substrate;

an air-filled cavity defined by the substrate and by the light redirecting assembly;

a linear array of discrete light sources positioned so as to emit light downwardly into the cavity, wherein the array of discrete light sources is affixed to a surface of the substrate facing into the air-filled cavity and extends along the long-side axis;

an electronic control for activating and powering the discrete light sources to emit the light;

an electrical connection between the discrete light sources and the electronic control for activating and powering the discrete light sources; and wherein a surface of the clear, light transmissive, semi-rigid, flexible film comprises: an array of optical relief structures projecting into the air-filled cavity, wherein the optical relief structures are selected from the group consisting of: V groove, isosceles triangular groove, right triangular groove, acute triangular groove, pyramid, square pyramid, square right pyramid, rectangular pyramid, rectangular right pyramid, rhombic pyramid, and polygonal pyramid.

2. The luminaire of claim 1 wherein the optical relief structures have at least two opposite sides and a base, and angles between faces on two opposite sides of the structures, and bases of the structures, are different from each other.

3. The luminaire of claim 1 wherein the optical relief structures have at least two opposite sides and a base, and angles between faces on two opposite sides of the structures and bases of the structures vary from structure to structure over at least a portion of the surface of the film.

4. The luminaire of claim 1 wherein the optical relief structures have rectangular bases and the dimensions of sides of the rectangular bases vary from structure to structure over at least a portion of the surface of the film.

5. The luminaire of claim 1 wherein the heights of the optical relief structures vary from structure to structure over at least a portion of the surface of the film.

6. The luminaire of claim 1 wherein the heights of the optical relief structures are between 5 and 200 microns.

7. The luminaire of claim 1 wherein the optical relief structures have at least rectangular bases, and sides of the rectangular bases are between 5 and 200 microns in length.

8. The luminaire of claim 1 wherein the optical relief structure comprises an array of grooves separated by ridges having triangular cross-sections;

the grooves have isosceles triangular cross-sections and the ridges have either right or acute triangular cross-sections;

the array covers the entire surface of the film and creates a surface topology on the film that has a sawtooth cross-sectional profile; and the triangular cross-sections of the ridges have base sides opposite the apices of the triangular cross-sections, wherein angles of the base sides with the two remaining sides of the triangular cross-sections vary across at least a portion the surface of the film.

9. The luminaire of claim 1 wherein the surface of the film having an array of optical relief structures has a surface topology comprised of an array of grooves that are separated by ridges having triangular cross-sections, wherein in some sections of the surface topology the triangular cross-sections of the ridges have the shape of right triangles and in other sections of the surface topology the ridges have the shape of isosceles triangles.

10. The luminaire of claim 9 wherein two sections of the surface topology having ridges with cross-sections having the shape of right triangles lie adjacent to and on opposite sides of a central axis of the film that extends the length of the substrate, and wherein vertical sides of the right triangular cross-sections are oriented towards the central axis.

11. The luminaire of claim 10 wherein the right triangular shapes of the cross-sections of the ridges vary across the sections, with angles of the triangular shapes opposite their vertical sides increasing with increasing distance from the central axis.

12. The luminaire of claim 10 wherein two additional sections of the surface topology having ridges with cross-sections having the shape of isosceles triangles lie adjacent to the two sections having ridges with cross-sections having the shape of right triangles.

13. The luminaire of claim 11 wherein angles of the triangular shapes opposite their vertical sides increase from 30 degrees to 50 degrees.

14. The luminaire of claim 12 wherein the four sections of the surface topology are equal in area.

15. The luminaire of claim 12 wherein the cross-sections having the shape of isosceles triangles have apex angles of 98 degrees.

16. The luminaire of claim 1 in which the shape of the light redirecting assembly is that of half of a hollow cylinder.

* * * * *